United States Patent [19]

Horbelt et al.

[11] Patent Number: 4,549,519

[45] Date of Patent: Oct. 29, 1985

[54] METHOD FOR OPERATING AN APPARATUS FOR A FUEL CONTROL SYSTEM OF AN INTERNAL COMBUSTION ENGINE DURING OVERRUNNING

[75] Inventors: Michael Horbelt, Schwieberdingen; Hans Schnürle, Walheim; Peter Strauss, Leonberg; Peter Werner, Wiernsheim, all of Fed. Rep. of Germany

[73] Assignee: Robert Bosch GmbH, Stuttgart, Fed. Rep. of Germany

[21] Appl. No.: 410,669

[22] Filed: Aug. 23, 1982

[30] Foreign Application Priority Data

Sep. 4, 1981 [DE] Fed. Rep. of Germany ..... 3134991

[51] Int. Cl.[4] ..... F02D 5/02

[52] U.S. Cl. ..... 123/493; 123/325

[58] Field of Search ..... 123/325, 326, 493

[56] References Cited

U.S. PATENT DOCUMENTS

| | | | |
|---|---|---|---|
| 3,570,460 | 3/1971 | Rabus | 123/325 |
| 4,221,193 | 9/1980 | Ezoe et al. | 123/493 X |
| 4,364,349 | 12/1982 | Miyagi et al. | 123/325 X |
| 4,385,596 | 5/1983 | Hosaka | 123/325 X |
| 4,392,467 | 7/1983 | Miyagi et al. | 123/325 |

*Primary Examiner*—Tony M. Argenbright

*Attorney, Agent, or Firm*—Edwin E. Greigg

[57] ABSTRACT

A method and an apparatus for overrunning control in an internal combustion engine are proposed, which operate with an overrunning cutoff and the reestablishment rpm of which is dependent on rpm and on time. At the onset of overrunning, a higher reestablishment rpm is selected, and once the rpm falls below a predetermined rpm value the reestablishment rpm is reduced according to a time function to a lower threshold value. The method may be realized by a controlled system, as well as by a control apparatus operating with analog circuitry.

3 Claims, 4 Drawing Figures

METHOD FOR OPERATING AN APPARATUS FOR A FUEL CONTROL SYSTEM OF AN INTERNAL COMBUSTION ENGINE DURING OVERRUNNING

BACKGROUND OF THE INVENTION

Overrunning is the term used for when an internal combustion engine has a higher rpm than would correspond to the position of the throttle valve, in an Otto engine, or to the injected fuel quantity in a Diesel engine. The simplest special case of overrunning exists when the driving pedal is in the position of rest but the rpm is above a specific value. In the overrunning condition, it is not desirable for the engine to perform work. To this end, the metered quantity of fuel is reduced and the instant of ignition is retarded as needed.

With a view to saving fuel, which becomes more and more important with time, devices were already developed quite early for shutting off the supply of fuel during the overrunning phase. However, a certain cooling down of the engine must then be accepted, and associated with it a worsening of the exhaust emissions for a certain period of time following the end of overrunning operation, and under some circumstances a certain sacrifice in driving comfort during the transition from overrunning to normal operation.

When effecting a cutoff of fuel supply during overrunning, it must be assured that the engine does not drop below a specific rpm value and die, as a result of the compulsory decrease in rpm which then occurs. Appropriate circuitry in many embodiments is already known for both carburetor and injection systems.

In practical operation it has proved difficult to effect a precise setting of the overrunning cutoff; the known systems, therefore, are not without problems under certain operating conditions, such as when the engine is cold.

OBJECT AND SUMMARY OF THE INVENTION

With the method of operation according to the invention and the corresponding apparatus for a fuel control system during overrunning of an internal combustion engine, even operating ranges of an internal combustion engine which are generally difficult to control can be controlled reliably. As a result, there is a substantial savings of fuel while driving comfort and operational reliability of the engine are substantially assured.

The invention will be better understood and further objects and advantages thereof will become more apparent from the ensuing detailed description of preferred embodiments taken in conjunction with the drawings.

DESCRIPTION OF THE EXEMPLARY EMBODIMENTS

Figure 1:
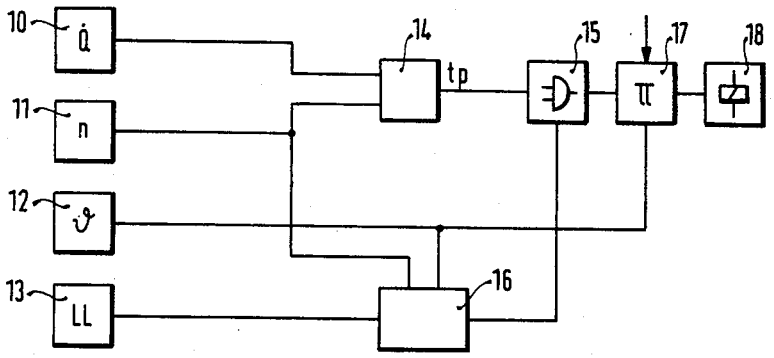
FIG. 1 is a schematic block illustration of an injection system in an internal combustion engine with externally supplied ignition.

The exemplary embodiments relate to appropriate control apparatus in an Otto engine having fuel injection. The basic elements of an injection system are shown in FIG. 1. The sensors for the air flowing through the intake tube, for the rpm, for the temperature and for idling are identified by reference numerals 10–13. 14 indicates a timing element in which basic injection pulses of the duration tp are formed in accordance with the air flow rate or throughput and rpm. A linking circuit 15 follows, for the output signals of the timing element 14 and of an overrunning shutoff circuit 16. This overrunning shutoff circuit 16 processes signals from the rpm sensor, the temperature sensor and the idling sensor and at its output side emits a cutoff signal. The linking circuit 15 is finally followed by a multiplier circuit 17 for an at least temperature-dependent correction of the injection signals and finally emits this correction to injection valves 18.

FIG. 1 shows nothing that is novel per se; it serves merely to illustrate the position of the method of operation according to the invention and the corresponding apparatus for a fuel control system during overrunning in the overall system.

Figure 2:
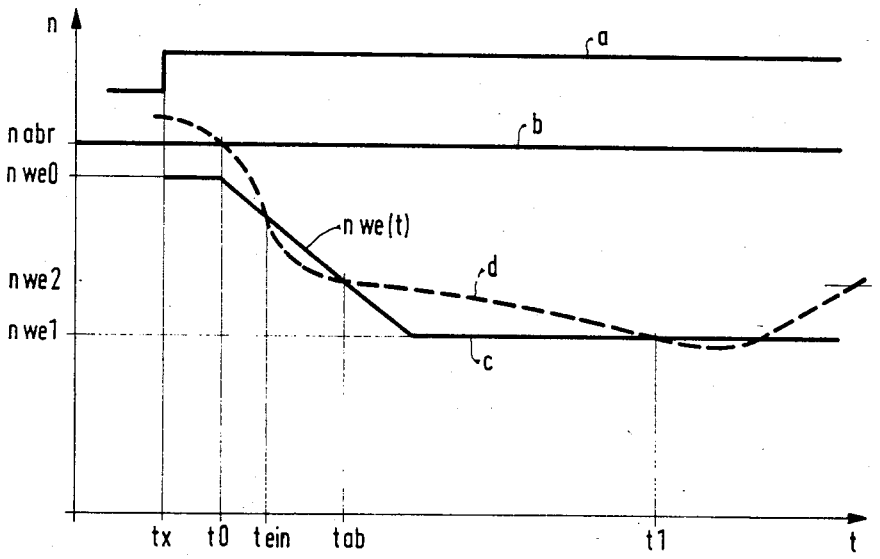
FIG. 2 provides a signal diagram explaining the mode of operation of the method according to the invention.

FIG. 2 shows signals according to which the method of the invention functions. A throttle valve switch signal a is shown plotted over the time. The higher value of this signal characterizes the status where the throttle valve is closed, which in the specialized case is one of the preconditions for overrunning.

The solid line identified by b indicates an rpm value n abr which is constant over time. FIG. 2 also shows a curce c, which is at a high value up to a time t0, then drops and finally remains at a lower threshold value. The upper threshold value of this curve c is marked n we0; the decreasing portion of the curve is marked n we(t), and finally the lower threshold value is marked n we1. Dashed lines indicate an actual rpm course d, which intersects the line b at the time t0, intersects the line n we(t) at the times t ein and t ab and finally falls below the threshold line n we1 at time t1 and then exceeds it once again. For a particular internal combustion engine, 700 to 1000 rpm has proved to be a suitable value for n we1. For a favorable spacing between the values n we0 and n we1, 400 to 800 rpm has ben determined, and finally, 50 to 150 rpm has proved to be a favorable spacing between line b and n we0.

At time tx, the throttle valve switch is closed and overrunning is this initiated. As a result, the rpm drops and falls below the line b at time t0, line b representing a so-called breakaway rpm n abr. At this time, the shutoff of line c begins according to the function n we(t). Because of the interruption of fuel supply to the engine at the beginning of overrunning at time tx, the rpm drops still further and at time t1 attains the reestablishment (for reestablishing fuel metering) rpm n we(t) which is regulated according to time. As the name indicates, the overrunning cutoff is terminated when the rpm falls below this line n we(t), and the supply of fuel is reestablished (although at a low level). As a result, the decrease in rpm slows down, and it once again exceeds the reestablishment curve c at the time t ab, with the result that the fuel supply is again interrupted. If the overrunning condition continues, as in the described example, then the actual rpm at time t1 again falls below the rpm value n we1, causing a reestablishment of the fuel supply once again. In this case, the actual rpm again increases and exceeds the line c. It has proved to be useful not to permit a new cutoff at least until the attainment of a predetermined rpm n we2, in order to avoid "see-sawing" of the engine.

FIG. 2 illustrates the advantages of the method according to the invention. When the engine is cold because of the relatively high frictional values rather steep rpm drops can occur, so that it is necessary to effect countermeasures in good time. As the example of FIG. 2 shows, the rpm drop is intercepted already at rpm values at a time t at which the probability of the engine's dying is low. The rpm gradient at time t1 is substantially smaller, so that the overall system can be intercepted and regulated substantially more easily when the rpm falls below this threshold rpm n we1 This threshold line n we1 adapts itself to the requirements of the minimum rpm for smooth and reliable operation. The time function in the curve course c must naturally be adapted to the particular engine type, and it represents a compromise between reliable interception of the condition on the one hand and the attempt not to switch fuel metering on and off overly frequently during normal operation.

The signal diagram of FIG. 2 can be attained with either digital or analog signal processing. Since computers are increasingly being used for control means in internal combustion engines, FIG. 3 shows an example of a flow diagram according to which a program can be prepared for a computer system.

Figure 3:
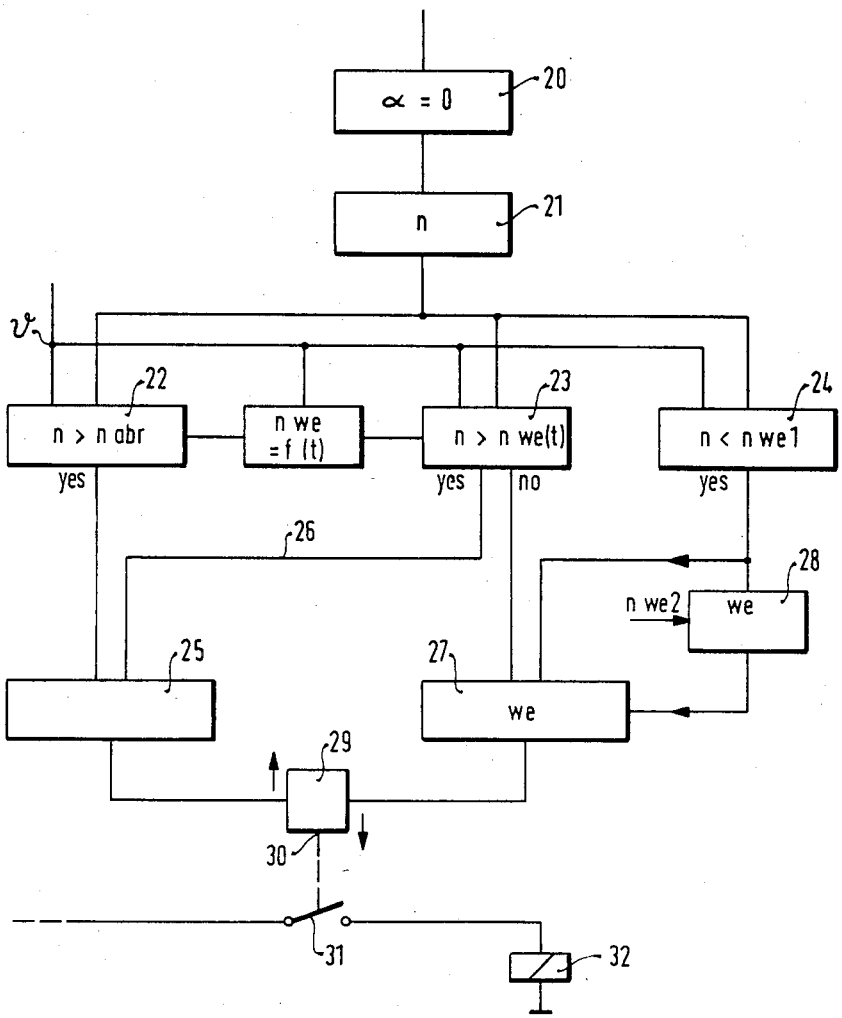
FIG. 3 is a flow diagram for the mode of operation of this method.

In the flow diagram of FIG. 3, 20 indicates a throttle valve position interrogation element. If the result is positive, then an rpm interrogation 21 is effected as to three values in the block 22, 23 and 24. In block 22, it is ascertained whether the rpm has fallen below the value of line b of FIG. 2 or not. In the case of a higher value, the overrunning cutoff immediately becomes effective, as is indicated by the block 25. If the instantaneous rpm has already fallen below the rpm value n abr, then the shutoff indicated by line c of FIG. 2 is effected according to the function n we(t), and in block 23 an interrogation is then performed as to whether this time-dependent reestablishment rpm value has been exceeded or whether the rpm has fallen below it. As long as the rpm is above this line, then the signal line 26 to block 25 of the overrunning cutoff is effected. If the actual rpm is below n we(t), then the fuel supply is reestablished, which is symbolized by block 27. Finally, the interrogation 24 ascertains the location of the actual rpm with respect to the absolute lower rpm threshold n we1. If the rpm has fallen below this threshold, then the fuel supply is again reestablished and remains in this state by means of a maintenance block 28 until the attainment of the rpm value n we2.

Output lines of the blocks 25 and 27 for overrunning cutoff and reestablishment of the fuel supply lead to a switching block 29, the output line 30 of which leads to a symbolically shown switch 31 in series with an injection valve 32. At either side of the switching block 29 there are arrows which indicate the corresponding position of the switch 31 given the various input signals.

Given an awareness of the flow diagram of FIG. 3, there is no difficulty for one skilled in the art of data processing associated with the preparation of a corresponding program for realizing the curve courses shown in FIG. 2.

Figure 4:
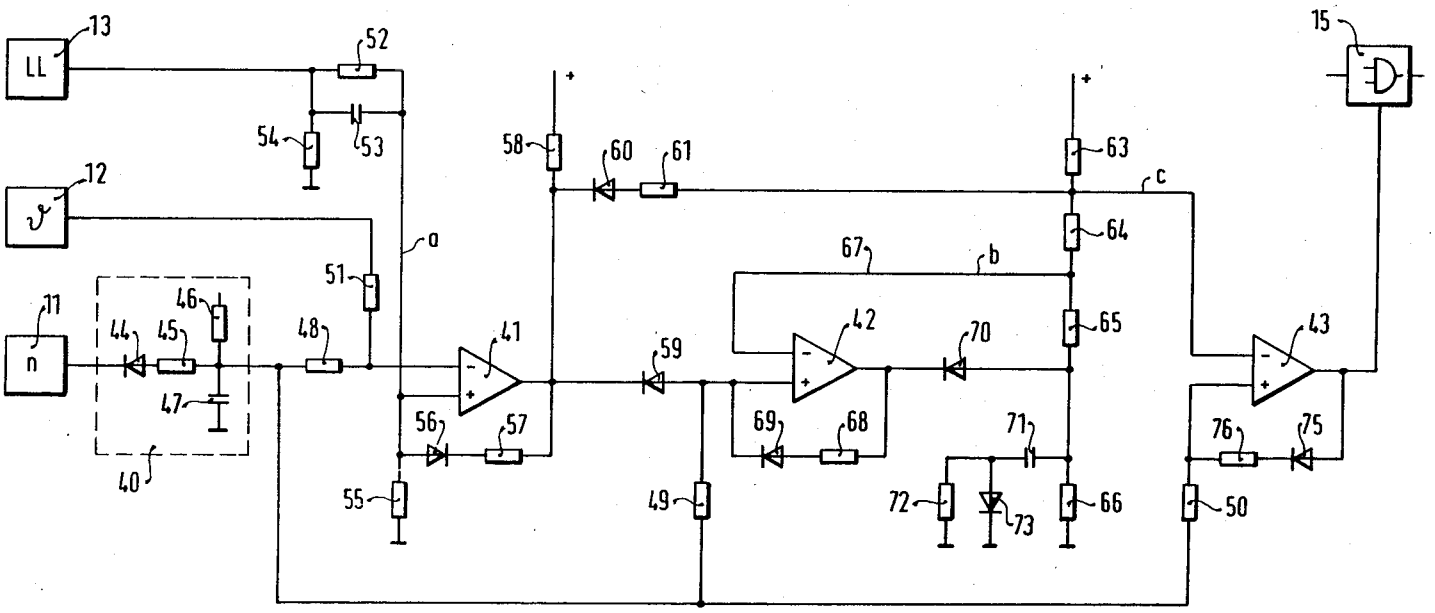
FIG. 4 shows a hardware-type exemplary embodiment of the apparatus according to the invention.

One possible means of realization of the overrunning control apparatus of FIG. 2 by analog circuitry is shown in FIG. 4.

The primary component of the circuitry shown in FIG. 4 is an rpm signal converter circuit 40, as well as three operational amplifiers 41, 42 and 43 functioning as comparators.

The rpm signal converter circuit 40 comprises a series circuit of a diode 44 and resistor 45 disposed between the input and the output as well as a resistor 46, connected from the input terminal to a positive line, and a capacitor 47 connected to ground. On the output side the rpm signal converter circuit 40 is connected via resistor 48 with the negative input of the operational amplifier 41 and via respective resistors 49 and 50 with the positive inputs of the operational amplifiers 42 and 43, respectively. The temperature sensor 12 is likewise coupled with the negative input of the operational amplifier 41 via a resistor 51. At the positive input of the operational amplifier 41, there is a signal arriving via a parallel circuit of resistor 52 and capacitor 53 from the throttle valve position sensor 13, the output signal of which is additionally applied to a resistor 54 connected to ground. From the positive input of the operational amplifier 41, a resistor 55 is also connected to ground and a series circuit of a diode 56 and a resistor 57 leads to its output. This output of the operational amplifier 41 is connected via a resistor 58 with a positive line, and further via a diode 59 with the positive input of the operational amplifier 42 and finally via a series circuit of a diode 60 and a resistor 61 with the negative input of the operational amplifier 43. A 3-stage voltage divider between the operating voltage terminals includes the resistors 63–66. While the connecting point of the two resistors 63 and 64 is connected to the negative input of the operational amplifier 43, a line 67 leads from the connecting point of the resistors 64 and 65 to the negative input of the operational amplifier 42. The output of this operational amplifier 42 is fed back to the positive input by means of a resistor 68 and a diode 69 and is also connected via a diode 70 with the connecting point of the two resistors 65 and 66, from which a capacitor also leads to a parallel circuit, connected to ground, comprising a resistor 72 and a diode 73. The operational amplifier 43 also has positive feedback by means of a diode-resistor combination 75 and 76, and its output leads to one of the inputs of the linking circuit 15 as shown in the circuit layout of FIG. 1.

The rpm signal converter 40 furnishes an output voltage which is inversely proportional to the instantaneous rpm of the engine. If the rpm value attains the signal level prevailing upon the line 67, which is determined by the resistance ratio of the four resistors 63–66, then the time t0 as shown in FIG. 2 has been attained, and the comparator having the operational amplifier 42 switches from low to high potential. The diode 70, which was previously conductive, accordingly blocks and the charging process in the capacitor 71 can begin. This in turn effects the downward control of curve c of FIG. 2. The charging process also affects the potential at the negative input of the operational amplifier 43, so that this operational amplifier either switches or does not switch in accordance with the instantaneous rpm value, and as a result also blocks or reestablishes the supply of fuel.

What is of significance for the lower rpm threshold n we1 of FIG. 1 is the external switching of the operational amplifier 41. If the switching threshold of this operational amplifier has been attained, then its switching state remains the same, because of the positive feedback via the resistor 57 and the diode 56, and the output signal remains at the same potential. Given this signal status, the potential of the connecting point of the two resistors 63 and 64 is reduced via the diode 60 and the resistor 61; the following operational amplifier 43 accordingly has a high output level and provides for a metering of fuel. Since the potential at the negative input of the operational amplifier 43 remains at a low value, fuel continues to be metered independently of the rpm values that occur.

In practical operation, the metering system of an internal combustion engine which functions as shown in FIG. 2 has proved to be extremely useful. This is because the cutoff during overrunning, which reduces fuel consumption, can be realized with this system while simultaneously assuring good driving comfort and extremely reliable operation using relatively simple means.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A method for controlling the fuel metering system of an internal combustion engine during overrunning in accordance with the actual rpm and a reestablishment rpm threshold for the reestablishment of fuel metering, comprising the steps of, reducing the reestablishment rmp threshold below a predetermined actual rpm (n abr) according to a time function (n we(t)) from a high initial threshold value (n $we_0$) to a low final value (n $we_1$), and interrupting the metering of fuel to the engine at rpm values above the reestablishment rpm.

2. A method as defined by claim 1, further comprising, suppressing at least untii the attainment of a predetermined higher rpm value (n $we_2$) a renewed cutoff when the rpm exceeds the lower reestablishment rpm threshold value (n $we_1$) following a phase of fuel metering.

3. A method as defined by claim 1, wherein the individual threshold values and threshold value functions for the reestablishment rpm are dependent at least on temperature.

* * * * *